US008366512B2

(12) United States Patent
Takeichi

(10) Patent No.: US 8,366,512 B2
(45) Date of Patent: Feb. 5, 2013

(54) EYEGLASS LENS PROCESSING APPARATUS FOR PROCESSING PERIPHERY OF EYEGLASS LENS AND EYEGLASS LENS PROCESSING METHOD

(75) Inventor: Kyoji Takeichi, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 691 days.

(21) Appl. No.: 12/626,708

(22) Filed: Nov. 27, 2009

(65) Prior Publication Data

US 2010/0136885 A1 Jun. 3, 2010

(30) Foreign Application Priority Data

Nov. 28, 2008 (JP) ..... 2008-305459

(51) Int. Cl.
*B24B 49/00* (2006.01)

(52) U.S. Cl. ..... 451/5; 451/9; 451/10; 451/11; 451/43; 451/255; 451/256

(58) Field of Classification Search ..... 451/5, 6, 451/9, 10, 11, 42, 43, 44, 255, 256
See application file for complete search history.

(56) References Cited

U.S. PATENT DOCUMENTS

| | | | | |
|---|---|---|---|---|
| 5,333,412 | A | 8/1994 | Matsuyama | |
| 6,641,460 | B2 | 11/2003 | Obayashi | |
| 6,790,124 | B2 | 9/2004 | Shibata | |
| 7,384,326 | B2 | 6/2008 | Yamamoto | |
| 2003/0087584 | A1 | 5/2003 | Shibata | |
| 2004/0209547 | A1 * | 10/2004 | Hatano et al. | 451/5 |
| 2010/0184356 | A1 * | 7/2010 | Haddadi et al. | 451/5 |

FOREIGN PATENT DOCUMENTS

JP 2003-145328 A 5/2003

* cited by examiner

*Primary Examiner* — Eileen P. Morgan
(74) *Attorney, Agent, or Firm* — Sughrue Mion, PLLC

(57) ABSTRACT

An eyeglass lens processing apparatus including a lens edge position detecting unit for obtaining edge positions, an edge corner processing tool for processing an edge corner of the lens, a correction data input unit for inputting correction data to avoid interference between an edge and a nose pad arm, wherein the correction data includes data on a position of interference between the nose pad arm and the edge, data necessary for setting an amount of processing at an interference position, and an edge processing range, a processing data computing unit for determining a path of processing the edge corner, based on edge position data and the correction data, to obtain data on correction processing and a processing controller for processing the edge corner of the lens by the edge corner processing tool in accordance with the correction processing data.

8 Claims, 12 Drawing Sheets

EYEGLASS LENS PROCESSING APPARATUS FOR PROCESSING PERIPHERY OF EYEGLASS LENS AND EYEGLASS LENS PROCESSING METHOD

BACKGROUND

The present invention relates to an eyeglass lens processing apparatus for processing a periphery of an eyeglass lens and an eyeglass lens processing method.

In an eyeglass lens processing apparatus, a periphery of a lens is processed on the basis of target lens shape data which is obtained from a rim (lens frame) of an eyeglass frame or a dummy lens. As for eyeglass frames, there are a rim type, a Naylor type (half rimless type), and a rimless type. In the case of the rim type, a bevel is formed on a periphery of the lens by a bevel processing tool to hold the lens in a groove of the rim. In the case of the Naylor type, a groove is formed in a periphery of the lens by a groove cutting tool. In the case of the rimless type, a hole is formed in a refractive surface of the lens by an endmill or the like. In recent years, an apparatus which permits bevel processing, groove processing, and drilling by one processing apparatus has been put to practical use (JP-A-2003-145328).

Incidentally, a metal frame is provided with a pair of nose pad arms, each having a curved shape for supporting a nose pad. For example, FIG. 7 shows an example of a rim type frame. A nose pad arm KA for supporting a nose pad NP is attached to a rim RM. The nose pad arm KA has a complexly curved shape in order to appropriately adjust the distance between the lens and an apex of the cornea of the eye or to allow the nose pad NP to be snugly brought into contact with the wearer's nose.

In general, a bevel is often formed at a periphery of the lens, which is fitted to the rim RM, such that the amount of projection of the lens toward the front side of the rim RM does not become excessively large. However, in beveling with an emphasis placed on the amount of projection of the lens toward the front side of the rim RM, there are cases where when an attempt is made to fit the lens, for which beveling has been completed, to the rim RM, the edge on the rear surface side of the lens and a portion of the nose pad arm KA unfavorably interfere with each other, making it difficult to fit the lens to the rim RM if the edge of the lens is thick. If an attempt is made to forcedly fit the lens to the rim RM, there occur such problems as the breakage of the lens, damaging a coating on the nose pad arm KA, and making it difficult to adjust the position of the nose pad NP. Although the interference with the lens can be avoided to some extent by the deformation of the nose pad arm KA, a forced deformation can possibly result in the breakage of the attachment of the nose pad arm KA. If a bevel is processed by being offset toward the rear surface side of the lens in order to avoid the interference with the nose pad arm KA, the amount of projection of the lens toward the front side becomes large, rendering the appearance poor.

Additionally, it is difficult for general operators to predict whether or not the interference with the nose pad arm KA will occur before lens processing, and they often notice the problem only after the lens has been fitted to the rim. In the case where an interference between the nose pad arm KA and the lens has occurred, by using a manual device having a conical grindstone, a skilled operator would be able to grind off an interfering portion by applying a corner of the lens edge against the grindstone, but it is difficult for a general operator to grind the lens with good appearance.

SUMMARY OF THE INVENTION

In view of the above-described problems of the conventional art, an object of an exemplary embodiment of the present invention is to provide an eyeglass lens processing apparatus which makes it possible to easily effect the processing of a lens with good appearance while avoiding interference between the nose pad arm and the lens.

To solve the problem, an eyeglass lens processing apparatus for processing a periphery of a lens according to the exemplary embodiment of the present invention, comprises:

a lens edge position detecting unit which obtains edge positions at a front face and a rear face of the lens based on target lens shape data;

an edge corner processing tool which processes an edge corner of the lens rear face;

a correction data input unit which inputs correction data of the edge corner for avoiding interference between an edge of the lens rear face after finish processing and a nose pad arm of an eyeglass frame, the correction data including data on a position of interference between the edge and the nose pad arm, data for setting a processing amount at the interference position, and a processing range of the edge;

a processing data computing unit which determines a processing path of the edge corner of the lens rear face, based on data on the edge position and the correction data, to obtain processing data; and a processing controller which processes the edge corner of the lens rear face by the edge corner processing tool in accordance with the processing data.

DETAILED DESCRIPTION OF EXEMPLARY EMBODIMENTS

Figure 1:
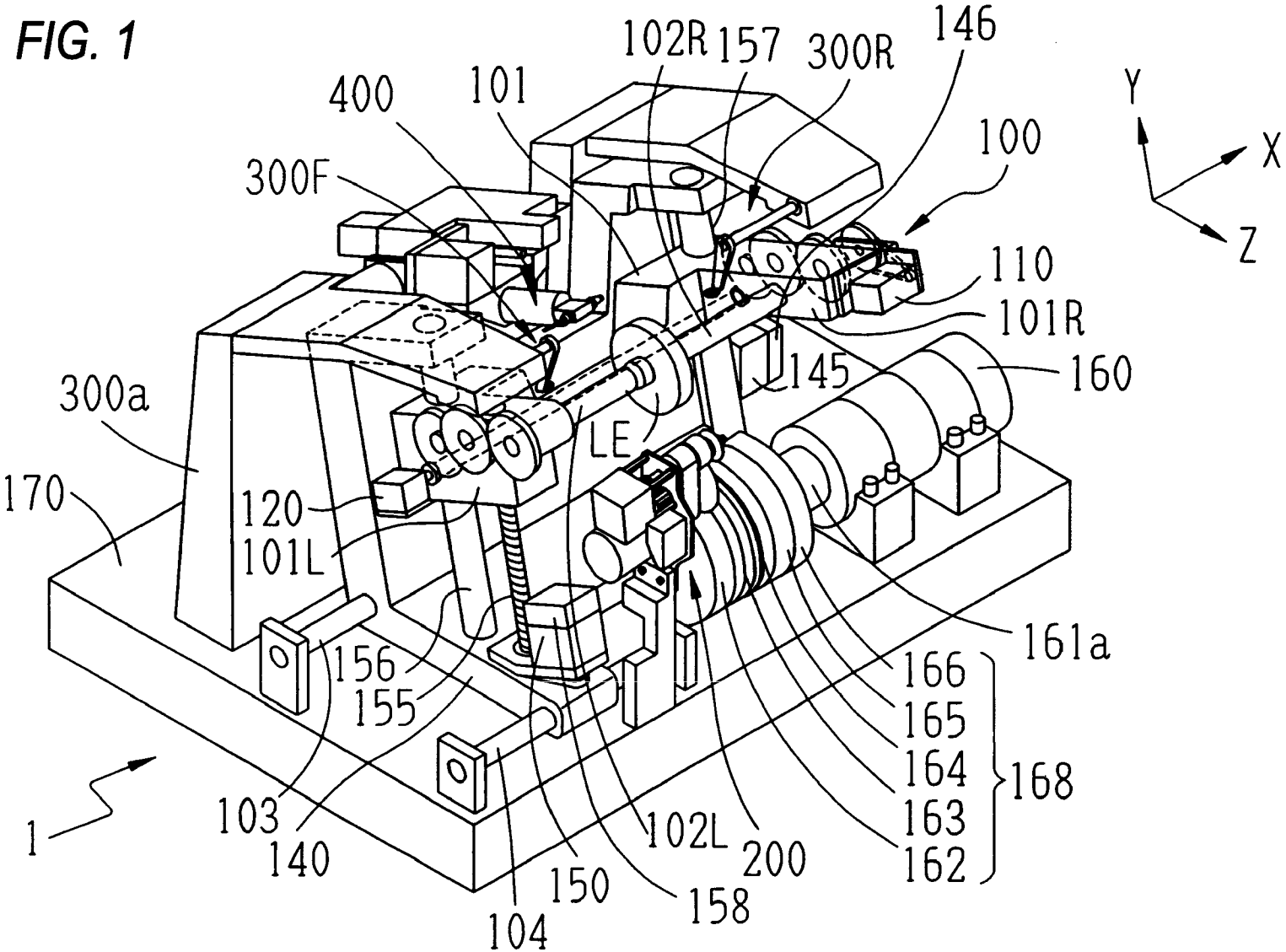
FIG. 1 is a schematic diagram of a processing section of an eyeglass lens processing apparatus.

Hereafter, with reference to the accompanying drawings, a description will be given of an exemplary embodiment of the invention. FIG. 1 is a schematic diagram of a processing section of an eyeglass lens processing apparatus.

A carriage section 100 is mounted above a base 170 of a processing apparatus body 1, and a periphery of an eyeglass lens LE clamped by lens chuck shafts 102L and 102R of a carriage 101 is processed by being brought into pressure contact with a group of grinding wheels 168 serving as lens periphery processing tools mounted coaxially on a grinding wheel spindle (grinding wheel rotating shaft) 161*a*. The group of grinding wheels 168 include a rough grinding wheel 162 for glass; a high-curve bevel finishing grinding wheel 163 having a tilted processing surface for forming a bevel on a lens with a high curve; a finishing grinding wheel 164 having a V-groove (beveling groove) VG for forming a bevel on a lens with a low curve and a flat processing surface; a mirror finishing grinding wheel 165; and a rough grinding wheel 166 for plastics. The grinding wheel spindle 161*a* is rotated by a motor 160.

The chuck shaft 102L and the chuck shaft 102R are rotatably held coaxially by a left arm 101L of the carriage 101 and a right arm 101R thereof, respectively. The chuck shaft 102R is moved toward the chuck shaft 102L by a motor 110 mounted on the right arm 101R, allowing the lens LE to be held by the two chuck shafts 102R and 102L. In addition, the two chuck shafts 102R and 102L are rotated in synchronism by a motor 120, which is mounted on the left arm 101L, through a rotation transmitting mechanism such as gearing. A lens rotating means is constituted by these members.

The carriage 101 is mounted on an X-axis movement support base 140, which is movable along shafts 103 and 104 extending in parallel to the chuck shafts 102R and 102L and the grinding wheel spindle 161*a*. An unillustrated ball screw extending in parallel to the shaft 103 is mounted in a rear portion of the support base 140. The ball screw is attached to a rotating shaft of an X-axis moving motor 145. As the motor 145 is rotated, the carriage 101, together with the support base 140, is linearly moved in an X-axis direction (axial direction of the chuck shaft). An X-axis direction moving means is formed by these members. An encoder 146, which is a detector for detecting the movement of the carriage 101 in the X-axis direction, is provided for the rotating shaft of the motor 145.

In addition, shafts 156 and 157, which extend in a Y-axis direction (a direction in which a center distance between, on the one hand, the chuck shafts 102R and 102L and, on the other hand, the grinding wheel spindle 161*a* is changed), are fixed to the support base 140. The carriage 101 is mounted on the support base 140 movably in the Y-axis direction along the shafts 156 and 157. A Y-axis moving motor 150 is fixed to the support base 140. The rotation of the motor 150 is transmitted to a ball screw 155 extending in the Y-axis direction, and as the ball screw 155 is rotated, the carriage 101 is moved in the Y-axis direction. A Y-axis direction moving means is formed by these members. An encoder 158, which is a detector for detecting the movement of the carriage 101 in the Y-axis direction, is provided for the rotating shaft of the motor 150.

Figure 2:
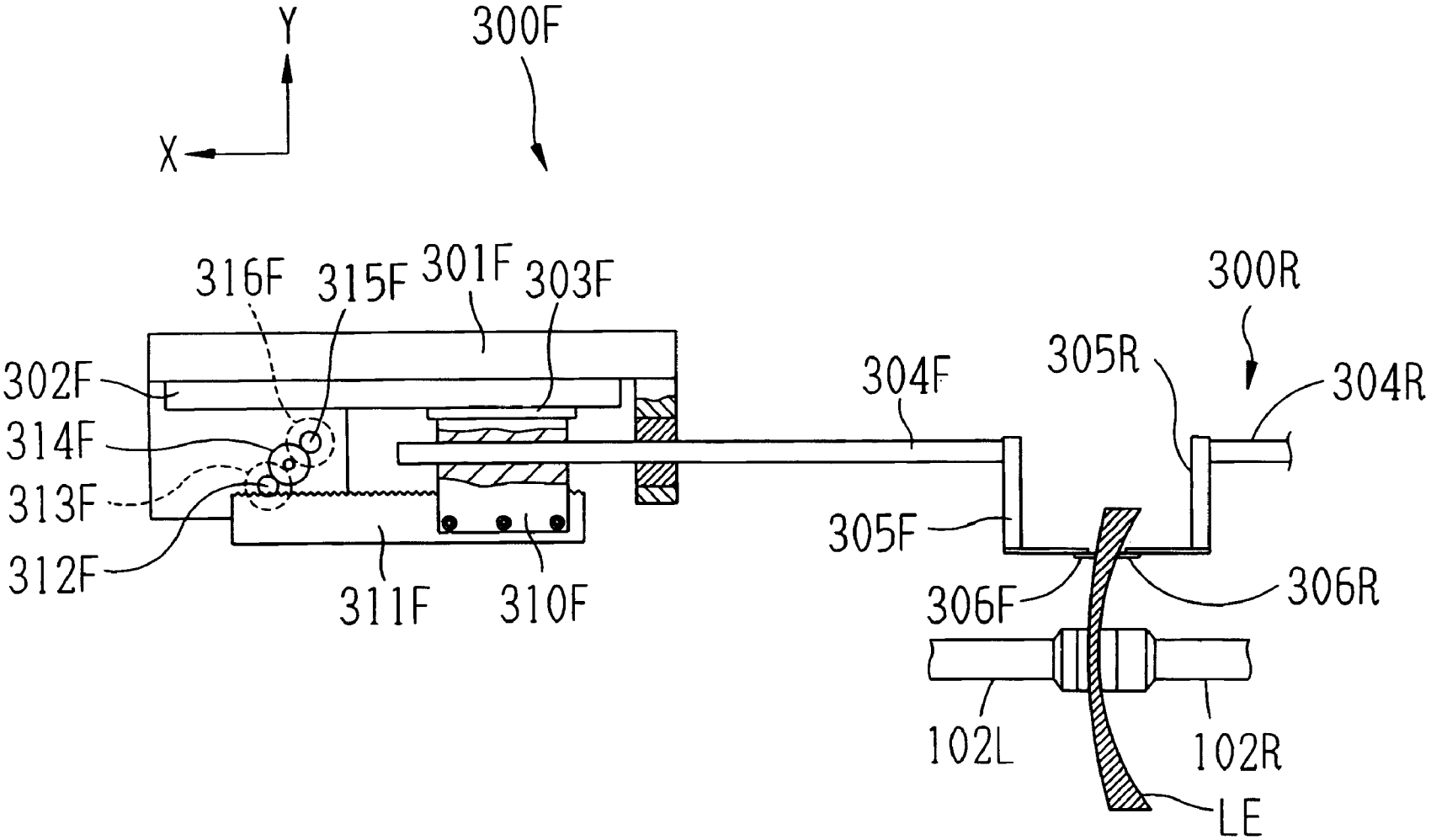
FIG. 2 is a schematic diagram of a lens edge position detecting unit.

In FIG. 1, lens edge position detecting units 300F and 300R are provided above the carriage 101. FIG. 2 is a schematic diagram of the detecting unit 300F for detecting the lens edge position of a front face of the lens. A mounting support base 301F is fixed to a support base block 300*a*, which is fixedly provided on the base 170 in FIG. 1, and a slider 303F is slidably fitted to a rail 302F, which is fixed to the mounting support base 301F. A slide base 310F is fixed to the slider 303F, and a measurement probe arm 304F is fixed to the slide base 310F. An L-shaped hand 305F is fixed to a distal end portion of the measurement probe arm 304F, and a measurement probe 306F is fixed to a distal end of the hand 305F. The measurement probe 306F is brought into contact with a front side refractive surface of the lens LE.

A rack 311F is fixed to a lower end portion of the slide base 310F. The rack 311F meshes with a pinion 312F of an encoder 313F fixed to the side of the mounting support base 301F. In addition, the rotation of a motor 316F is transmitted to the rack 311F through a gear 315F, an idle gear 314F, and the pinion 312F to move the slide base 310F in the X-axis direction. During the measurement of the lens edge position, the motor 316F constantly presses the measurement probe 306F against the lens LE with a fixed force. The force with which the measurement probe 306F is pressed against the lens refractive surface by the motor 316F is imparted with a light force so as not to scar the lens refractive surface. As a means for imparting the pressing force of the measurement probe 306F against the lens refractive surface, it is possible to use a known pressure imparting means such as a spring. By detecting the position of movement of the slide base 310F, the encoder 313F detects the position of movement of the measurement probe 306F in the X-axis direction. The edge position of the front face of the lens LE (including the position of the front face of the lens) is measured from information of this movement position, information of rotational angles of the chuck shafts 102L and 102R, and information of movement thereof in the Y-axis direction.

As for the detecting unit 300R for detecting the edge position at the rear face of the lens LE, since its configuration is bilaterally symmetric with that of the detecting unit 300F, the character "F" at the end of the reference numeral allotted to each component element of the detecting unit 300F shown in FIG. 2 will be replaced by "R," and a description thereof will be omitted.

In the measurement of the lens edge position, the measurement probe 306F is abutted against the front face of the lens, and a measurement probe 306R is abutted against the rear face of the lens. In this state, the carriage 101 is moved in the Y-axis direction on the basis of target lens shape data, and as the lens LE is rotated, edge positions at the lens front face and the lens rear face are simultaneously measured for the processing of lens peripheries. It should be noted that in the edge position detecting means in which the measurement probe 306F and the measurement probe 306R are configured to be integrally movable in the X-axis direction, the lens front face and the lens rear face are measured separately. In addition, although in the above-described lens edge position measuring section the chuck shafts 102L and 102R are arranged to be moved in the Y-axis direction, it is possible to adopt a mechanism in which the measurement probe 306F and the measurement probe 306R are relatively moved in the Y-axis direction.

Figure 3:
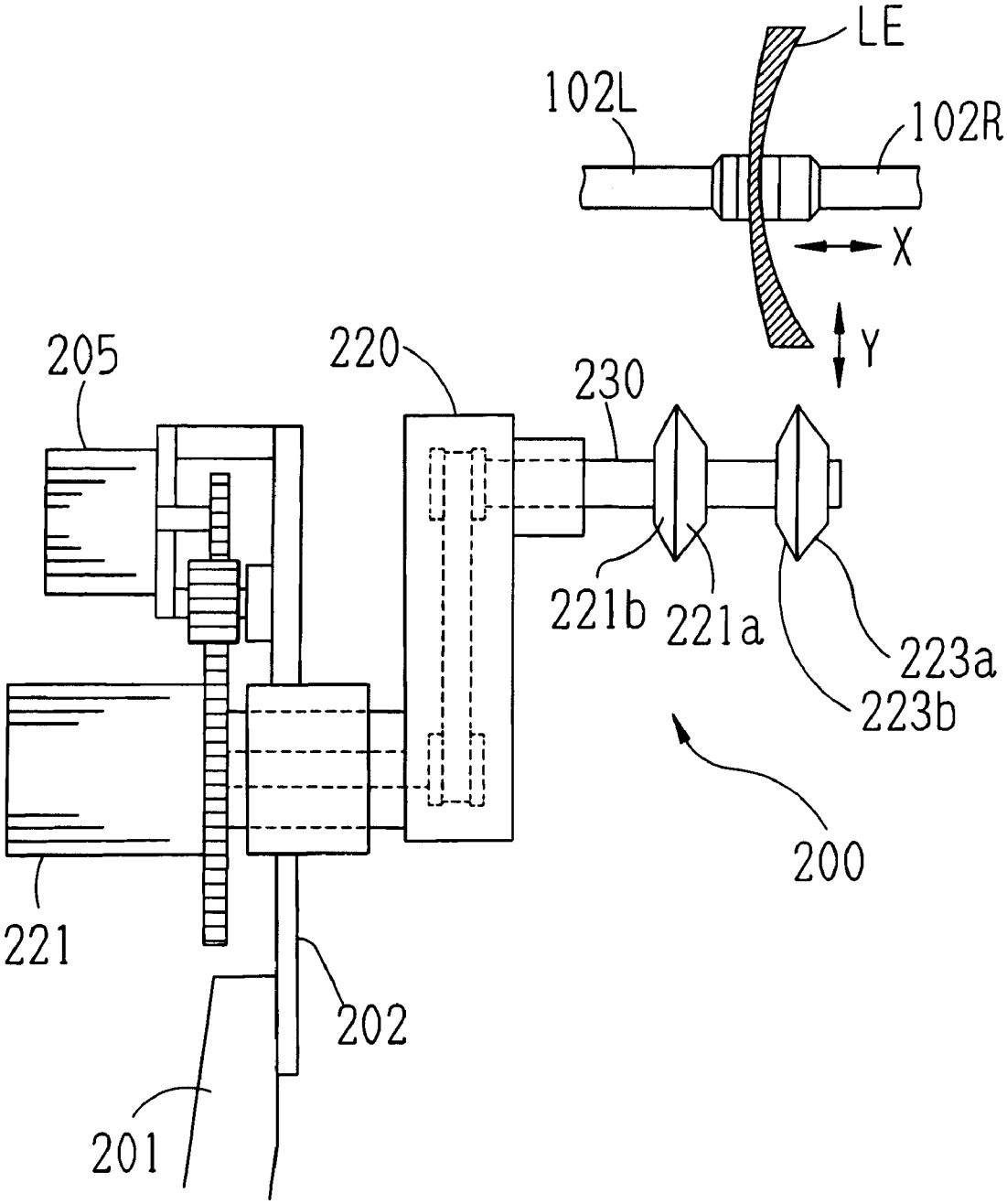
FIG. 3 is a diagram of a chamfering mechanism section.

In FIG. 1, a chamfering mechanism section. 200 is disposed on this side of the apparatus body in FIG. 1. FIG. 3 is a diagram of the chamfering mechanism section 200. A chamfering grinding wheel 221*a* for the lens front face, a chamfering grinding wheel 221*b* for the lens rear face, a mirror-chamfering grinding wheel 223*a* for the lens front face, and a mirror-chamfering grinding wheel 223*b* for the lens rear face are coaxially mounted on a grinding wheel rotating shaft 230 which is rotatably attached to an arm 220. The grinding wheel rotating shaft 230 is rotated by a motor 221 through a rotation transmitting mechanism such as a belt in the arm 220. The motor 221 is fixed to a fixed plate 202 extending from a support base block 201. In addition, a motor 205 for arm rotation is fixed to the fixed plate 202, and as the motor 205 is rotated, the grinding wheel rotating shaft 230 is moved from a retreated position to a processing range shown in FIG. 3. The processing range of the grinding wheel rotating shaft 230 is at a position, which is between the grinding wheel rotating shaft 161*a* and each of the lens rotating shafts 102R and 102L and which is parallel on a plane where these rotating shafts are located. In the same way as the processing of the lens periphery by the grinding wheels 168, the lens LE is moved in the Y-axis direction by the motor 150, and the lens LE is moved in the X-axis direction by the motor 145, to thereby carry out the chamfering processing of the lens periphery. In the correction processing of a lens edge corner for avoiding the interference with a nose pad arm KA of the eyeglass frame, the rear face chamfering grinding wheel 221*b* (during mirror processing, plus the chamfering grinding wheel 223*b*) is used as an edge corner processing tool. As the edge corner processing tools, it is also possible to use a cutter, an endmill, or the like.

Figure 4:
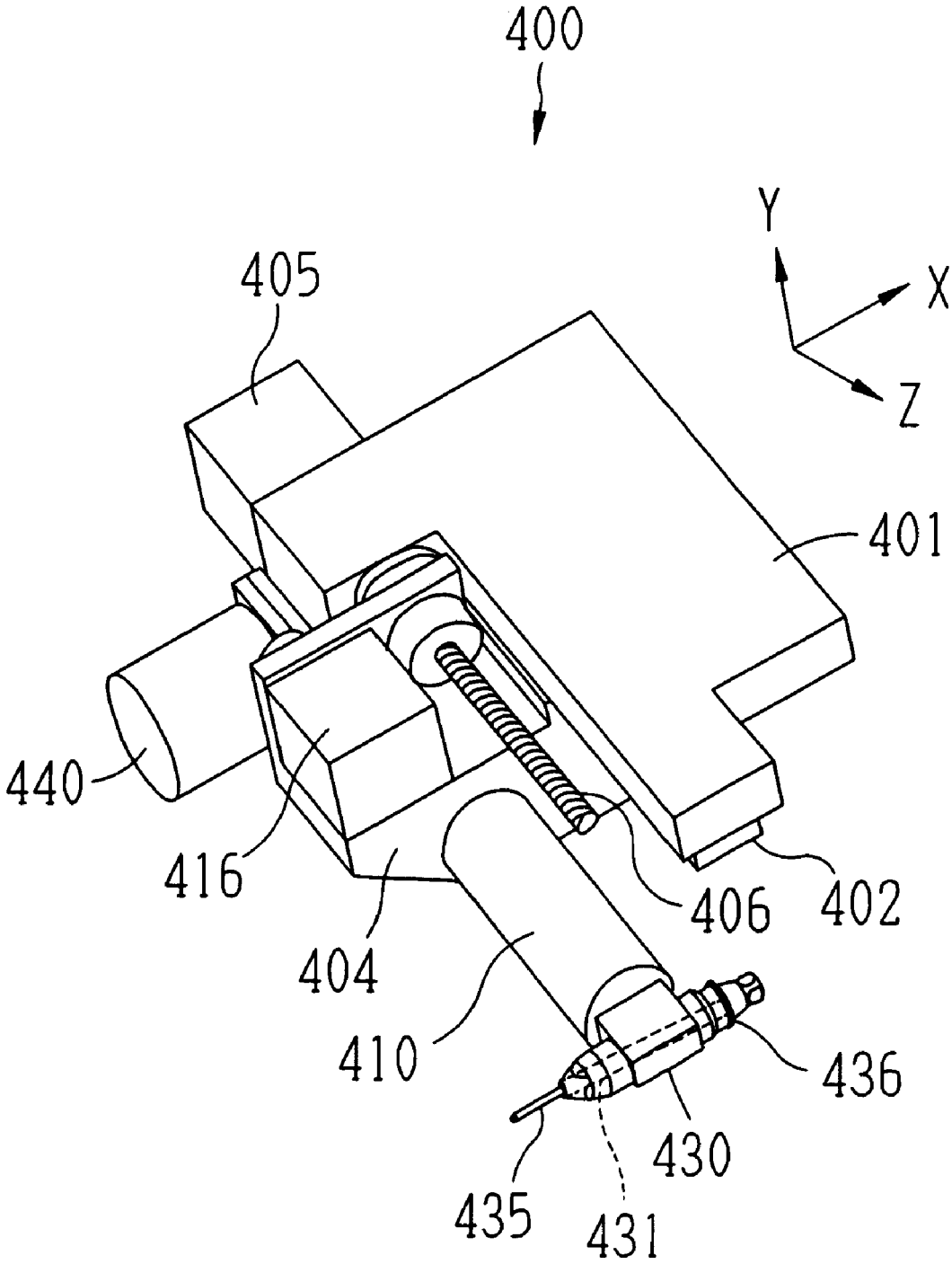
FIG. 4 is a schematic diagram of a hole processing/groove cutting mechanism section.

In FIG. 1, a hole processing/groove cutting mechanism section 400 is disposed in the rear of the carriage section 100. FIG. 4 is a schematic diagram of the mechanism section 400. A fixed plate 401 serving as a base of the mechanism section 400 is fixed to a block (not shown) provided uprightly on the base 170 in FIG. 1. A rail 402 extending in a Z-axis direction (direction perpendicular to the X-Y axis plane) is fixed to the fixed plate 401, and a Z-axis movement support base 404 is slidably mounted along the rail 402. The movement support base 404 is moved in the Z-axis direction as a motor 405 rotates a ball screw 406. A rotation support base 410 is rotatably held by the movement support base 404. The rotation support base 410 is rotated by a motor 416 about its shaft through a rotation transmitting mechanism.

A rotating portion 430 is attached to a distal end portion of the rotation support base 410. A rotating shaft 431, which is perpendicular to the axial direction of the rotation support base 410, is rotatably held in the rotating portion 430. An endmill 435 serving as a hole processing tool is coaxially mounted to one end of the rotating shaft 431, and a groove cutter 436 serving as a groove cutting tool is coaxially mounted to the other end of the rotating shaft 431. The rotating shaft 431 is rotated by a motor 440, which is mounted on the movement support base 404, through a rotation transmitting mechanism disposed inside the rotating portion 430 and the rotation support base 410. In this embodiment, the endmill 435 is configured to be directed toward the lens front face and to effect drilling from the lens front face side.

As for the configurations of the above-described carriage section 100, the lens edge position detecting units 300F and 300R, and the hole processing/groove cutting mechanism section 400, as it is basically possible to use those described in JP-A-2003-145328 (U.S. Pat. No. 6,790,124), a detailed description thereof will be omitted.

Figure 5:
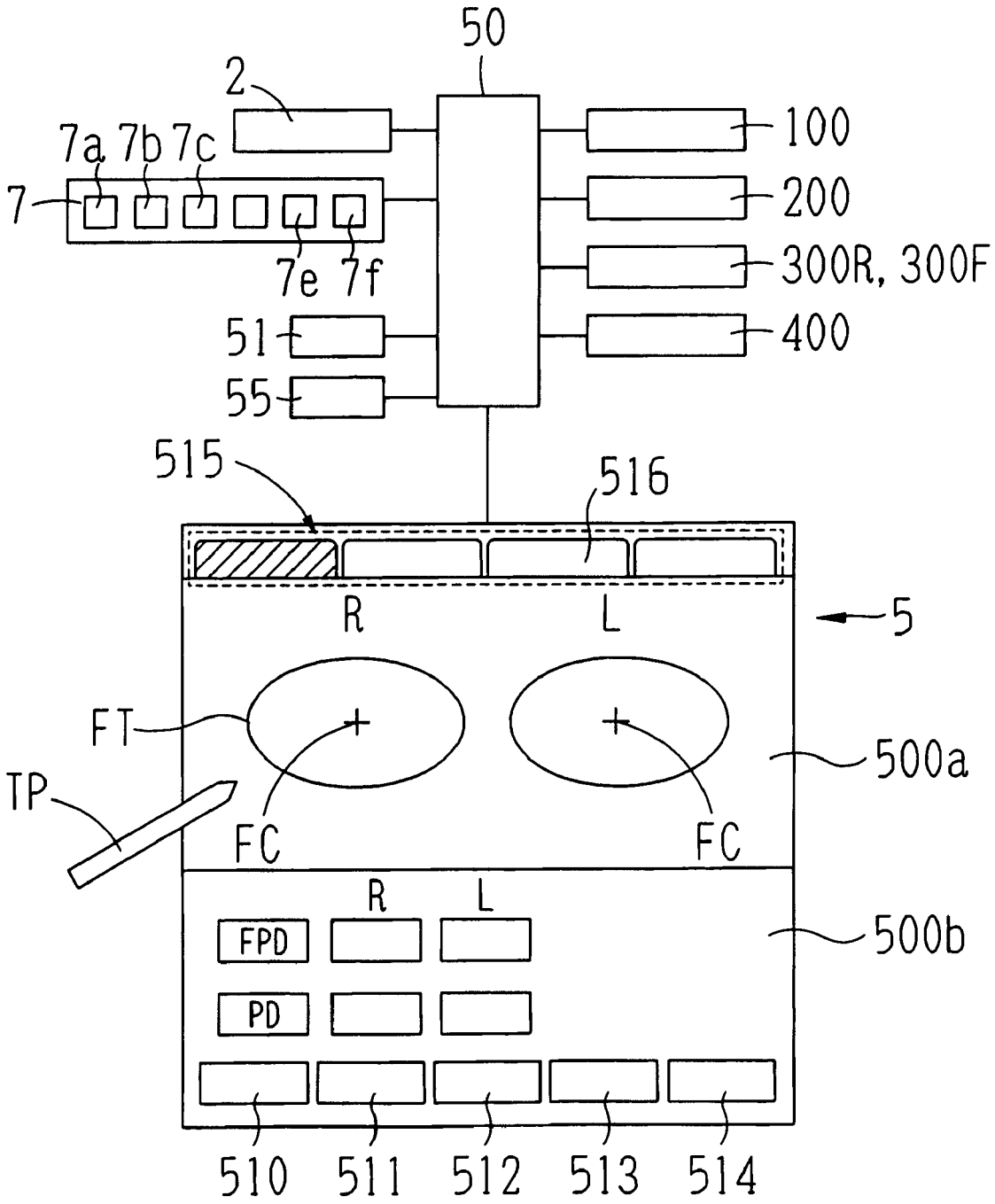
FIG. 5 is a control block diagram of the eyeglass lens processing apparatus.

FIG. 5 is a control block diagram of the eyeglass lens processing apparatus. Connected to a control section 50 are an eyeglass frame shape measuring section 2 (an example described in JP-A-4-93164 (U.S. Pat. No. 5,333,412) could be used), a display 5 having a touch panel function, a switch section 7, a memory 51, the carriage section 100, the chamfering mechanism section 200, the lens edge position detecting units 300F and 300R, the hole processing/groove cutting mechanism section 400, and the like. On the display 5, it is possible to input a predetermined signal with respect to a display on the screen by the touching operation of an operator's finger or a touch pen TP. The control section 50 receives the input signal through the touch panel function provided in the display 5, and controls the display of graphics and information on the display 5. Arranged on the switch section 7 are a start switch 7*a* for inputting a processing start signal, a retouch switch (second grinding switch) 7*b* for inputting a start signal at the time of effecting correction processing with respect to a processed lens, a switch 7*c* which is used at the time of adjusting the interference position kp to be described later, and the like.

Next, a description will be given of the operation of the apparatus having the above-described configuration. Here, a description will be given by centering on the operation in a case where the interference with the nose pad arm KA is avoided.

The target lens shape data, which is obtained on the basis of the rim (lens frame) shape measured by the eyeglass frame shape measuring section 2, is inputted by the pressing of a switch provided in the switch section 7, and is stored in the memory 51. The target lens shape data is imparted as (rn, θn)(n=1, 2 . . . N) in the format of a radial length and a radial angle.

When the target lens shape data is inputted, a target lens shape graphic FT based on the target lens shape data is displayed on a screen 500*a* of the display 5. On the screen 500*a*, it is possible to input a wearer's pupillary distance (PD value), a frame pupillary distance (FPD value) of left and right rims RM, and layout data (data on the positional relationship of an optical center of the lens LE with respect to a geometric center of the target lens shape) such as the height of the optical center of the lens LE with respect to the geometric center of the target lens shape. The layout data is inputted as a predetermined touch key displayed on a screen 500*b* is operated. In addition, through touch keys 510 to 514, various processing conditions are set, including the lens material, the type of the eyeglass frame (Naylor type, full metal type, cell type, rimless type, etc.), the processing mode (bevel processing, flat processing, etc.), presence or absence of chamfering processing, the chuck center of the lens (optical center chuck, frame center chuck), and the like. Here, it is assumed that the lens material has been set to "plastic," by the touch key 510; the type of frame has been set to "metal" by the touch key 511 the processing mode has been set to "bevel processing" by the touch key 512; the chamfering processing has been set to "OFF (not provided)" by the touch key 513; and the chuck center of the lens has been set to "frame center mode" by the touch key 514.

Figure 6:
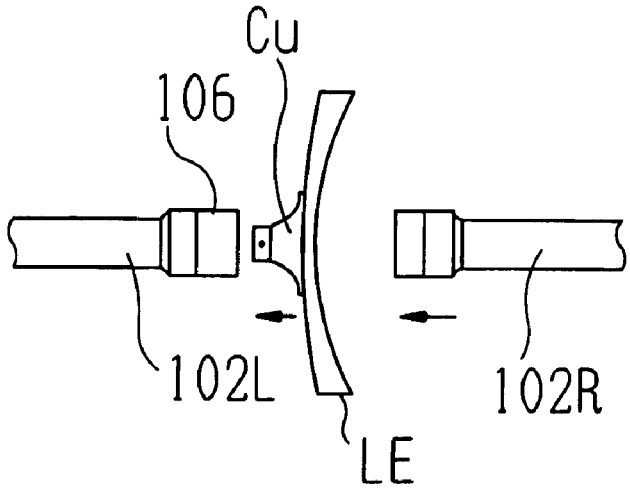
FIG. 6 is a diagram explaining the chucking of a lens.
Figure 7:
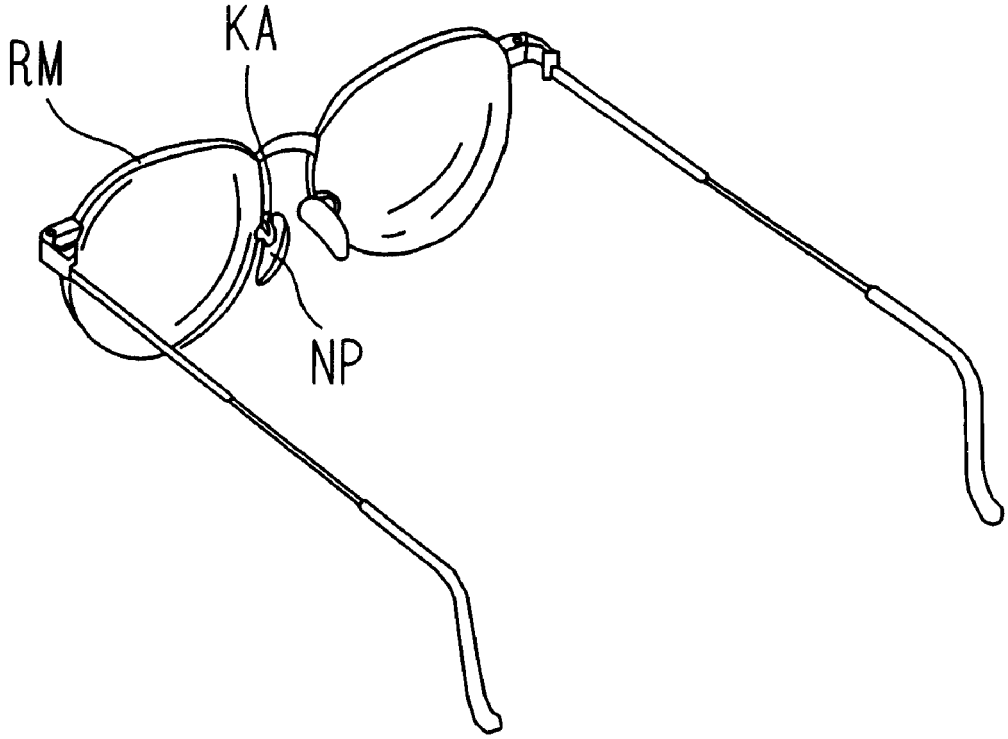
FIG. 7 is a diagram illustrating an example in which a nose pad arm is fitted to an eyeglass frame.

Next, prior to the processing of the lens LE, the operator fixes a cup Cu, i.e., a fixing jig, to the front face of the lens LE by using a known aligner (see FIG. 6). In the frame center mode, the geometric center FC of the target lens shape is held by the chuck shafts 102R and 102L, and serves as the rotational center of the lens LE (processing center of the lens LE).

Upon completion of the inputting of data necessary for processing, as shown in FIG. 6, the operator fits a proximal portion of the cup Cu fixed to the lens LE to a cup holder 106 attached to a distal end of the chuck shaft 102L, and then moves the chuck shaft 102R toward the lens LE side to chuck the lens LE by the chuck shafts 102R and 102L. The operator presses the start switch 7*a* to operate the apparatus. The control section 50 operates the lens edge position detecting units 300F and 300R by the start signal, and measures the edge positions at the front face and the rear face of the lens on the basis of the target lens shape data. The measurement positions at the front face and the rear face of the lens are, for example, the bevel apex position and a position located a predetermined amount (0.5 mm) outwardly of the bevel apex position. When the edge position information of the front face and the rear face of the lens is obtained, a bevel path is computed by the control section 50. As the bevel path, the bevel apex is set over the entire circumference so as to divide the edge thickness, for instance, by a predetermined ratio (e.g., 3:7 from the front face side of the lens).

Subsequently, the Y-axis movement of the chuck shafts 102R and 102L is controlled on the basis of the target lens shape data, and the periphery of the lens LE is rough processed by the rough grinding wheel 166. Then, the X-axis movement and the Y-axis movement of the chuck shafts 102R and 102L are controlled on the basis of the bevel path data, and a bevel is formed on the periphery of the lens LE by the finishing grinding wheel 164.

Figure 8:
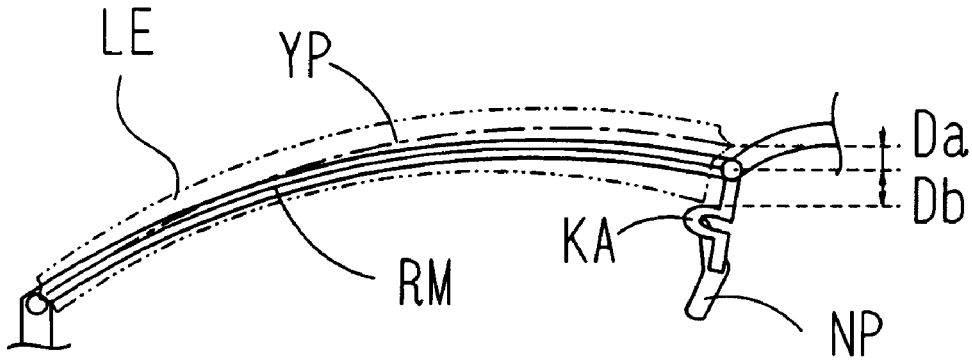
FIG. 8 is a diagram explaining interference between an edge on the lens rear side and the nose pad arm.
Figure 9:
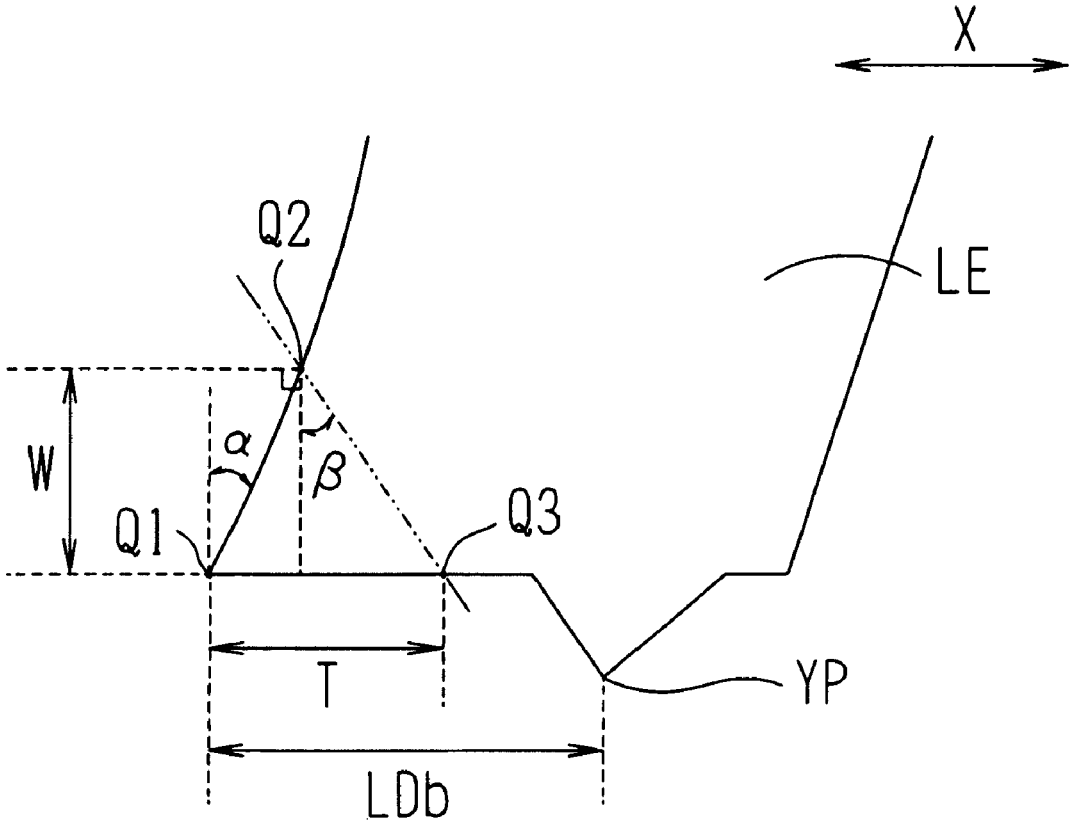
FIG. 9 is a diagram explaining a method of determining a correction processing path.

Upon completion of the bevel processing, the operator tentatively fits the lens LE to the rim RM with the cup Cu fixed to the lens LE, and confirms the presence or absence of interference between the nose pad arm KA and the edge at the lens rear face. Here, in a case where the lens edge is thick, and the distance from the bevel formed at the lens periphery to an edge corner on the rear side of the lens is long, an interference occurs between the edge corner on the rear side of the lens and the nose pad arm KA, as shown in FIG. 8. In this case, as correction data of the edge corner necessary for avoiding the interference between the nose pad arm KA and the lens, the operator obtains information on a correction processing amount T at the edge position of the nose pad arm KA. The correction processing amount T is obtained as a distance from an edge position Q1 on the lens rear face side to a position Q3 in the direction of the edge, as shown in FIG. 9. It is possible to know the extent of the correction processing amount T based on a distance Da between a bevel apex VP and a groove center of the rim RM, as measured by calipers or the like, in the vicinity of the nose pad arm KA when the edge corner on the lens rear face side is brought into contact with the nose pad arm KA, as shown in FIG. 8. Alternatively, it is possible to obtain the correction processing amount T in the vicinity of the nose pad arm KA by measuring a distance Db between the groove center of the rim RM and the nose pad arm KA, measuring a distance LDb (see FIG. 9) between an edge corner (edge position Q1) on the lens rear face side and a bevel apex YP in the vicinity of the nose pad arm KA, and determining a difference between the distance Db and the distance LDb.

A description will now be given of a method of determining a correction processing path for avoiding the interference of the nose pad arm KA. FIG. 9 is a cross-sectional view of the lens at the position (interference position Kp) of the nose pad arm KA. It is assumed that a distance W (processing width on the lens rear face side) between a processing point Q2 on the lens rear face and an edge position Q1 at the lens rear face, which is processed by the rear face chamfering grinding wheel 221*a* is determined at the position of the nose pad arm A. Further, it is assumed that a correction processing amount from the edge position Q1 to a processing point Q3 on an edge side is T, and an angle of inclination of the lens rear face (angle of inclination with respect to a plane perpendicular to the X axis) is α. Further, it is assumed that an angle of inclination of the processing surface of the lens rear face chamfering grinding wheel 221*b* is β. It should be noted that the angle of inclination α of the lens rear face can be obtained by performing edge position measurement twice at the edge position after the finish processing and on the inner side or outer side located a predetermined distance (0.5 mm) therefrom (even if it is considered to be an approximately a straight line, the problem in practical use is small). When the correction processing amount T is set, the processing width W can be obtained by the following formula.

{Mathematical Formula}

$$W = \frac{T}{\tan a + \tan b} \quad \text{(Formula 1)}$$

Then, as the processing width W is obtained, the position data of the processing point Q2 with respect to the edge position Q1 at the lens rear face is obtained.

Figure 10:
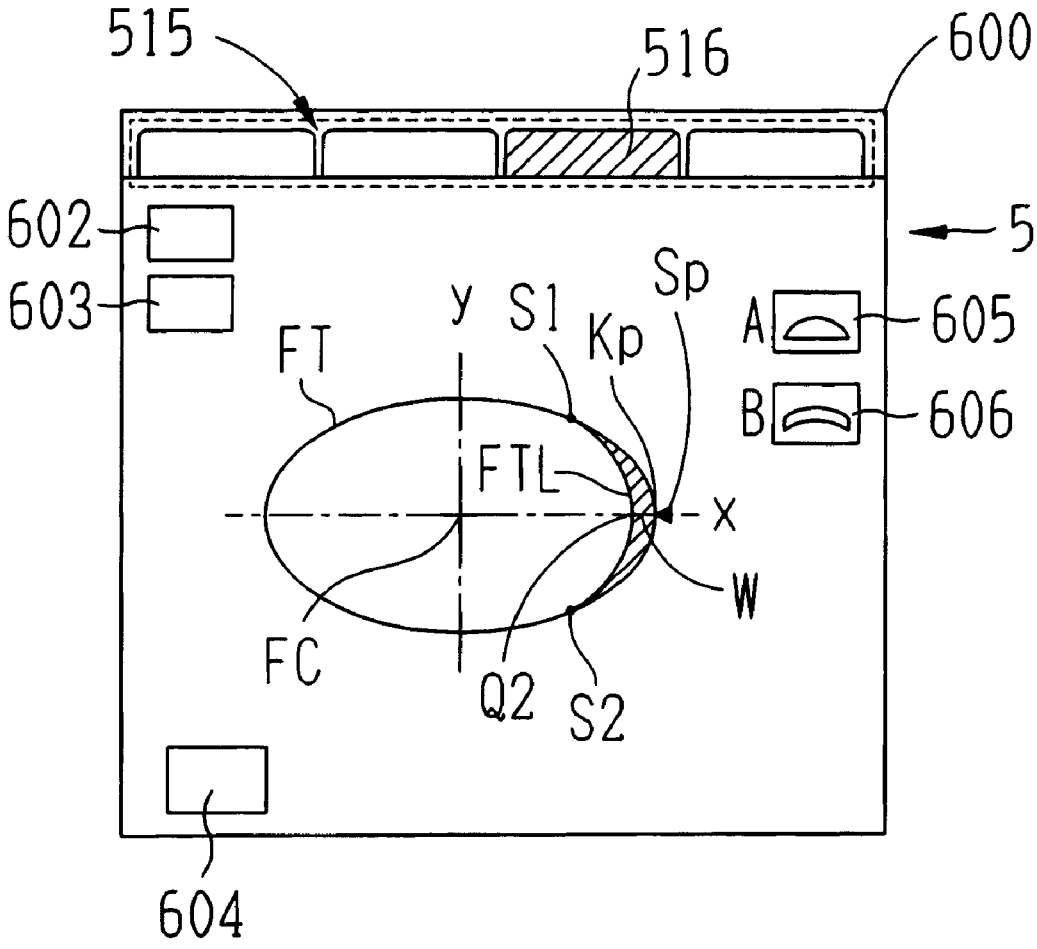
FIG. 10 is a diagram illustrating an example of an interference avoiding edit screen.

Next, a description will be given of a method of setting correction data for processing a lens corner with good appearance, while avoiding interference between the nose pad arm KA and the lens. The display 5 is used as a correction data input unit. If a tab key 516 is selected among screen changeover tabs 515 being displayed on the display 5, the screen is changed over to an edit screen 600 for avoiding the interference (hereinafter, the interference avoiding edit screen). A target lens shape graphic FT based on the lens shape data is displayed in the center of the interference avoiding edit screen 600 in a substantially actual size. Provided on the left side of the screen is a switch 602 for changing over the target lens shape between a state in which it is viewed from the front face side of the lens and a state in which it is viewed from the rear face side of the lens, as well as a switch 603 for allowing a corner processing portion set on the nose side of the target lens shape graphic FT to be reflected on the rear side. In the example of FIG. 10, a state in which the lens shape is viewed from the rear face side of the lens is shown. In addition, an entry column 604 for inputting the correction processing amount T of the nose pad arm KA is provided on the lower side of the screen. Switches 605 and 606 for selecting the processing style of the edge corner of the lens are provided on the right side of the screen.

A description will be given of a method of inputting data in which the correction processing range has been designed as the correction amount data for avoiding the interference. The operator designates a starting point S1 and an ending point S2 of the processing range on the target lens shape graphic FT by means of the touch pen TP so that the edge position (interference position) where the nose pad arm KA is estimated to be located will be included. After the designation of the starting point S1 and the ending point S2, marks indicating the starting point S1 and the ending point S2 are displayed on the target lens shape graphic FT. At this stage, when the starting point S1 and the ending point S2 of the correction processing range are designated, the interference position Kp of the nose pad arm KA is tentatively set at an intermediate position between the starting point S1 and the ending point S2, and a mark Sp indicating the interference position Kp is displayed on the target lens shape graphic FT. In addition, the operator is able to input the correction processing amount T of the lens corner. A numerical keypad screen (not shown) is displayed by selecting the entry column 604, and the correction processing amount T is entered by the operation of touch keys on the numerical keypad screen. In addition, the operator selects a processing style when the lens shape is viewed from the lens rear face side (or the lens front face side) by the selection switches 605 and 606.

Figure 11A:
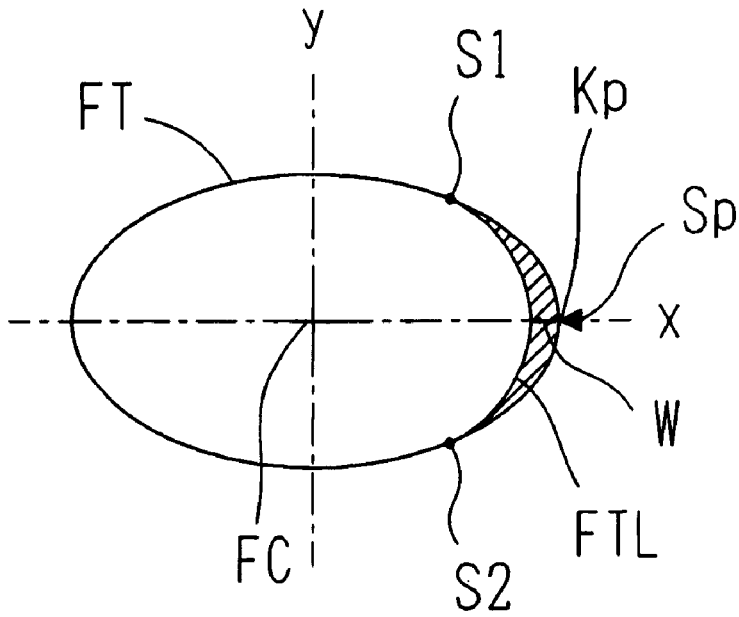
FIG. 11A is a diagram explaining a method of designing a correction processing range.

FIG. 11A is an explanatory diagram of a processing style A when the switch 605 is selected. In the processing style A, the processing width W is made gradually large starting from the starting point S1 and is made maximally large at the interference position Kp when viewed from the lens rear face side. The processing width W at the interference position Kp is computed according to the aforementioned Formula 1 by inputting the correction processing amount T. Then, a processing line FTL on the lens rear face side is set so that the processing width W becomes gradually narrow from the interference position Kp to the ending point S2 (so that the processing width W decreases as it moves away from the interference position Kp). It should be noted that the processing width W is calculated as a distance in a direction in which a target lens shape center Fc (processing center) and the edge position are connected. The processing width W may be handled as a distance in the normal direction of the edge position. In addition, a sinusoidal function is used in the calculation for obtaining the processing line FTL of the design in which the processing width W is gradually increased/decreased. It is also possible to use an involute function or the like as the calculating method for gradually increasing/decreasing the processing width W.

Figure 11B:
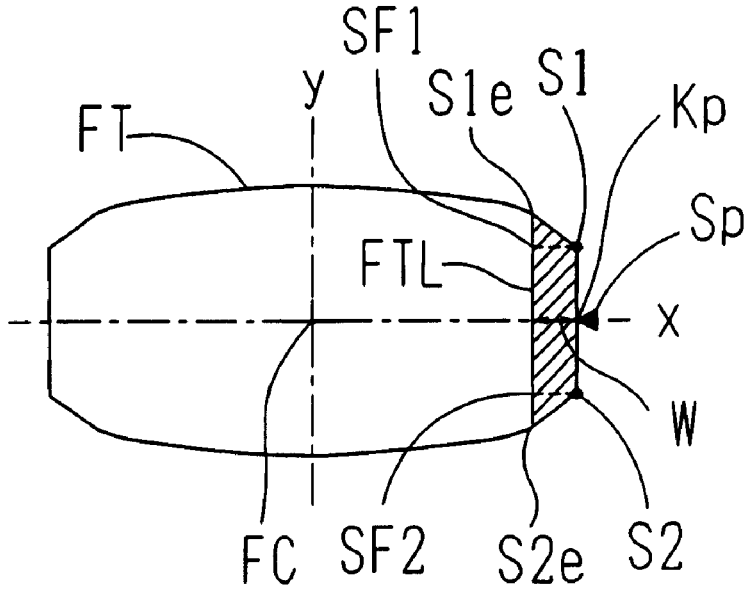
FIG. 11B is a diagram explaining a method of designing the correction processing range.

FIG. 11B is an explanatory diagram of a processing style B when the switch 606 is selected. In the processing style B, when the starting point S1 and the ending point S2 are designated, the processing line FTL is set so that the processing width W, set at the interference position Kp, is fixed from the interference position Kp to the ending point S2 along the edge position of the target lens shape. Then, with respect to the portion located upwardly of the starting point S1, a processing line is set in which a tangent of the processing line FTL is extended from a position SF1 on the processing line FTL, which corresponds to the starting point S1, to an edge position S1*e*. Also as for the portion located downward of the ending point S2, a processing line is set in which a tangent of the processing line FTL is extended from a position SF2 on the processing line FTL, which corresponds to the ending point S2, to an edge position S2*e*.

The above-described styles A and B are selected according to the target lens shape. For example, the style A is selected in the case where the target lens shape (rim RM) in the vicinity of the interference position Kp is curved, thereby making it possible to design the correction processing range with good appearance. The style B is selected in the case where the target lens shape is linear, thereby making it possible to design the correction processing range with good appearance. Thus, by preparing a plurality of processing styles and making them selectable, the operator is able to easily design the correction processing range with the best appearance in correspondence with the lens profile. It should be noted that types combining the above-described styles A and B may be prepared in advance as the selection of the processing styles. In addition, as the method of designing the processing correction range on the target lens shape graphics, it is possible to adopt a method in which the processing line FTL is set arbitrarily by the touch pen TP. After the design of the correction processing range has been tentatively set, the operator presses the switch 7*c* disposed in the switch section 7 to select an adjustment mode of the interference position Kp. When the adjustment mode is selected, the touch panel function of the display 5 is set to invalid (OFF).

Figure 12:
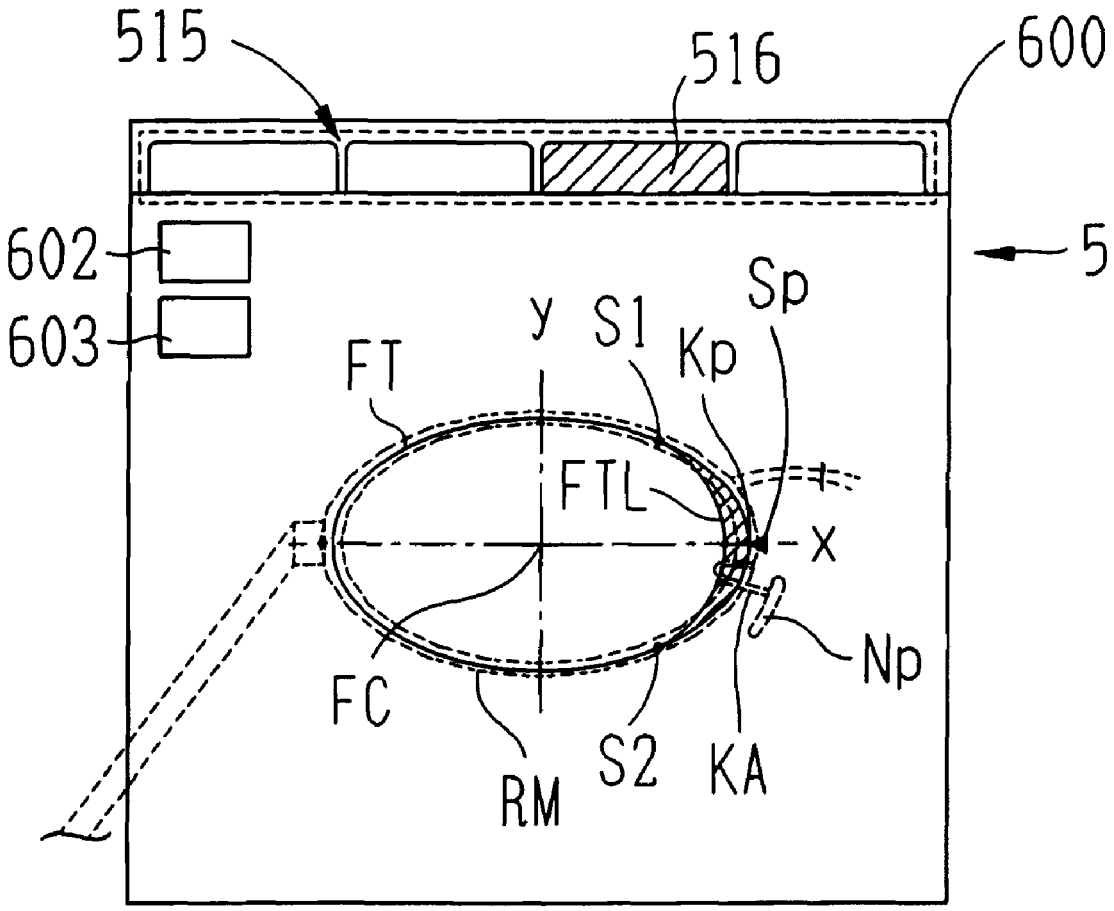
FIG. 12 is a diagram illustrating an example of a display screen in an adjustment mode.

FIG. 12 is an example of the display screen in the adjustment mode. In this example, the style A has been selected. The operator places the rim RM of an actual eyeglass frame (in the case of a Naylor type and a rimless type, a portion corresponding to the rim, with a dummy lens fitted) on the display 5, and superposes it on the target lens shape graphic FT. Then, the operator confirms the positions of the nose pad arm KA and the mark Sp indicating the interference position Kp of the target lens shape graphic FT with respect to the edge position. Since the target lens shape graphic FT is displayed in a substantially actual size, the operator is able to confirm the actual position of the nose pad arm KA with respect to the edge position of the target lens shape graphic FT. In addition, since the touch panel function has been set to OFF, even if the rim RM is placed on the display 5, an erroneous response is not given. When the tentatively set interference position Kp (mark Sp) is offset from the actual nose pad arm KA, the operator moves the mark Sp by means of a switch 7*e* or 7*f* in the switch section 7 so as to finely adjust the position of the interference position Kp. When the switch 7*e* is pressed, the mark Sp is moved counterclockwise on the target lens shape graphic FT. When the switch 7*f* is pressed, the mark Sp is moved clockwise on the target lens shape graphic FT. In the example of FIG. 12, since the actual nose pad arm KA is located on the lower side of the tentatively set mark Sp, the operator moves the mark Sp clockwise on the target lens shape graphic FT by means of the switch 7*f* so as to adjust the interference position Kp to the position of the actual nose pad arm KA.

Figure 13:
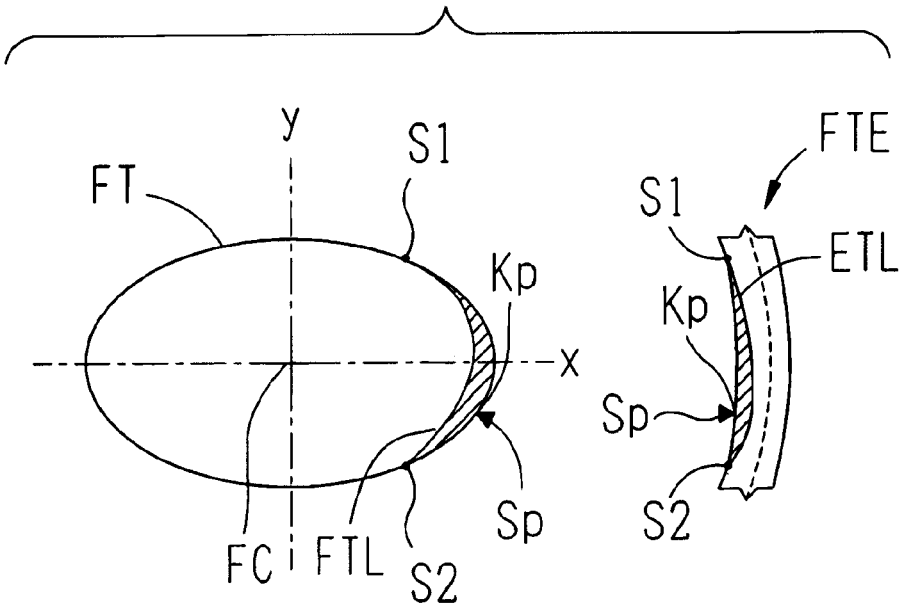
FIG. 13 is a diagram explaining the correction processing range after adjustment of the processing interference position.

Upon completion of the adjustment of the interference position Kp, the operator presses the switch 7*c* to cancel the adjustment mode. When the switch 7*c* is pressed again, the touch panel function of the display 5 is again set to valid (ON). FIG. 13 is a diagram of the correction processing range after the adjustment. It should be noted that, in this example, a graphic FTE in which the lens is viewed from the side is also displayed simultaneously. A processing line ETL in which the processing range is viewed from the side is displayed in the side view FTE. It should be noted that an understanding can be facilitated if a side view is similarly displayed in FIG. 10 as well.

From the display of the processing line FTL in the target lens shape graphic FT and the processing line ETL in the side view FTE, the operator confirms whether or not the design of the finished shape is appropriate. In the event that the correction of the starting point S1 and the ending point S2 of the correction processing range has become necessary, the starting point S1 or the ending point S2 is touched by the touch pen TP and is dragged, thereby making it possible to move the starting point S1 or the ending point S2. When the starting point S1 or the ending point S2 is moved, the display of the processing lines FTL and ETL is changed while the interference position Kp is maintained.

When the processing line FTL in the target lens shape graphic FT is determined, the processing point Q3 on the lens side face is computed for each radial angle on the basis of the processing width W at each radial angle, the edge position Q1 of the lens, the angle of inclination a of the lens rear face, and the angle of inclination β of the processing surface of the chamfering grinding wheel 221*b*, to thereby determine the processing line ETL in the side view FTE. Namely; as for the processing point Q3 for each radial angle, as the processing width W in Formula 1 above is designated for each radial angle, the correction processing amount T for each radial angle is computed. As a result, the processing point Q3 for each radial angle is determined and is obtained as data (rQn, θn, zQn) (n=1, 2, . . . , N) of a correction processing path Q3*n* for avoiding the interference with the nose pad arm KA. In addition, the processing line ETL is determined by the correction processing path Q3*n*. The data of the correction processing path Q3*n* is stored in the memory 51.

Figure 14:
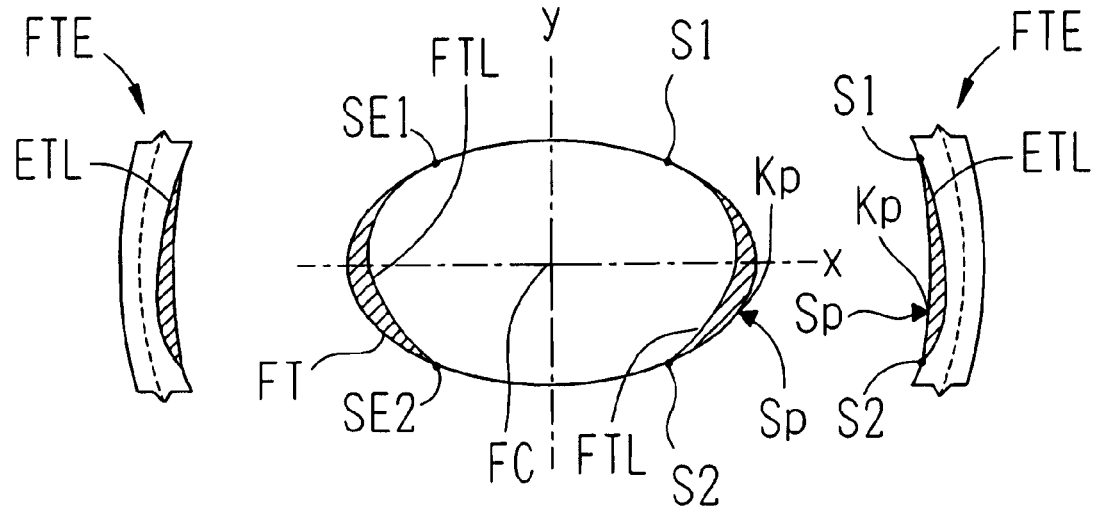
FIG. 14 is an explanatory diagram of the correction processing range which is set on an ear side.

It should be noted that if the processing for interference avoidance is provided only for the nose side of the lens (one side in the left-right direction), there is a possibility that the balance of appearance when the lens is viewed from the front side becomes poor. In this case, if the switch 603 on the interference avoiding edit screen 600 is pressed, data on the positions of the starting point S1 and the ending point S2 of the processing portion on the nose side and the processing width W for each radial angle are computed in such a manner as to be horizontally inverted with respect to the y-axis passing through the geometric center FC of the target lens shape. Then, as shown in FIG. 14, a starting point SE1 and an ending point SE2 of the correction processing range on the ear side (the other side in the left-right direction) are set in the target lens shape graphic FT, and the processing line FTL and the processing line ETL are respectively set in the target lens shape graphic FT and the side graphic FTE. As a result, a processing portion similar to that of the nose side portion is also designed on the ear side portion with a good balance. As the processing line FTL is set in the target lens shape graphic FT, a correction processing path on the ear side of the lens is computed in the same way as described above.

It should also be noted that in the setting of the processing portion on the ear side, the processing portion can be designed into a desired shape by designating the starting point SE1 and the ending point SE2 in the target lens shape graphic FT on the interference avoiding edit screen 600, and by inputting the processing width W in the target lens shape (or the correction processing amount T in the side face).

When the correction processing path Q3*n* for avoiding the interference with the nose pad arm KA is determined as described above, the operator again fits the proximal portion of the cup Cu, which has been fixed to the processed lens, to the cup holder 106 on the chuck shaft 102L side, and moves the chuck shaft 102R toward the lens LE side to chuck the lens LE by the chuck shafts 102R and 102L. Then, the operator presses the retouch switch 7*b* to start the correction processing. In this instance, when the retouch switch 7*b* is pressed, the processing in the processing range, which has been set as shown in FIG. 13, is carried out for the initial processing of the lens periphery.

The control section 50 fetches the correction processing path Q3*n* from the memory 51 and operates the chamfering mechanism portion 200. The control section 50 first drives the motor 205 to move the grinding wheel rotating shaft 230 placed in the retreated position to the processing position, and rotates the chamfering grinding wheel 221*b* for the lens rear face by means of the motor 221. Next, the control section 50 converts data into correction processing data for moving the chuck shafts 102R and 102L in the Y-axis direction and the X-axis direction relative to the chamfering grinding wheel 221*b* on the basis of the correction processing path Q3*n*. Further, the control section controls the rotation of the lens LE by the motor 120 and controls the movement of the lens LE by the motor 150 and the motor 145 in the Y-axis direction and the X-axis direction in accordance with the correction processing data, to thereby process an edge corner of the lens rear face by the chamfering grinding wheel 221*b*. In addition, when the correction processing portion has been set on the ear side of the lens, the control section 50 converts data into correction processing data on the basis of that correction processing path, and controls the driving of the motors 120, 150, and 145 in accordance with the correction processing data, to thereby process the edge corner of the lens rear face by the chamfering grinding wheel 221*b*.

Figure 15:
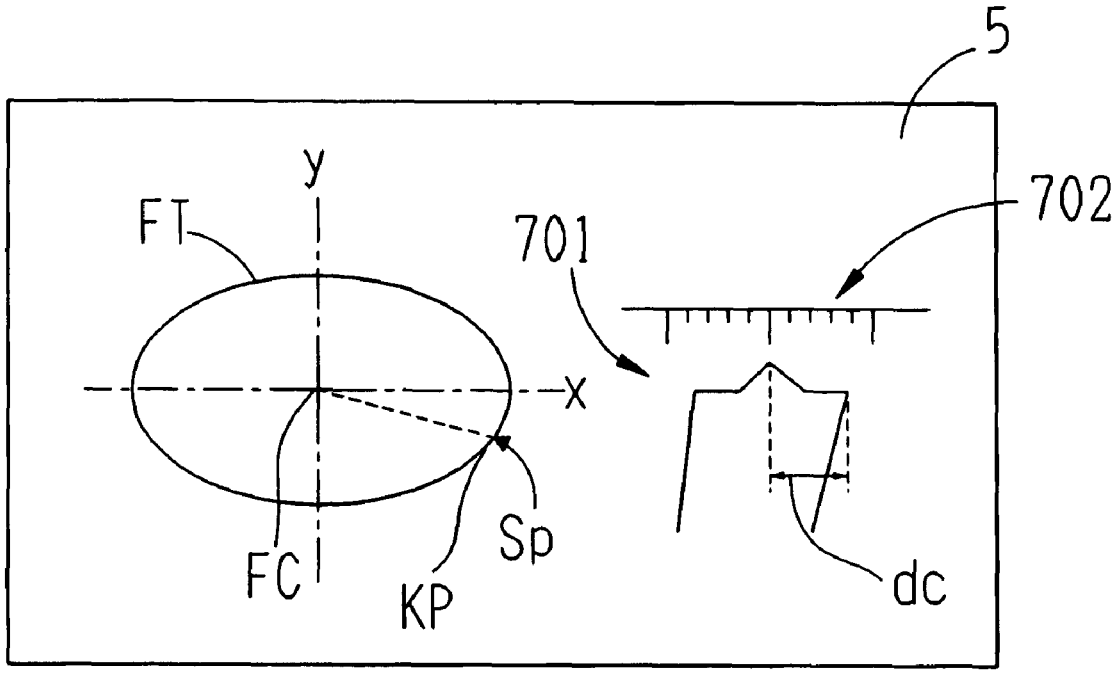
FIG. 15 is an explanatory diagram in a case where interference avoidance of the nose pad arm is effected prior to lens processing.

Although, in the above description, the presence or absence of interference between the nose pad arm KA and the lens is confirmed by fitting the processed lens LE to the rim RM, this confirmation can also be made prior to the processing of the lens LE. For example, when a beveling path is computed after the measurement of edge positions at the lens front face and the lens rear face by the lens edge position detecting units 300F and 300R, a simulation screen for designating the position of the nose pad arm KA is displayed on the display 5, as shown in FIG. 15. The target lens shape graphic FT on the screen of the display 5 is displayed in a substantially actual size in the same way as in the case of FIG. 12. After changing over the mode to the adjustment mode by pressing the switch 7*e*, the operator places the rim RM of the actual eyeglass frame onto the display 5 to superpose it on the target lens shape graphic FT to confirm the position of the nose pad arm KA with respect to the edge position of the target lens shape graphic FT. Then, the operator moves the mark Sp by means of the switch 7*e* or 7*f* to designate the position of the nose pad arm KA on the target lens shape graphic FT. After the designation of the edge position by the mark Sp, a lens cross-sectional graphic 701 at the designated position is displayed on the screen. Also, a scale 702, which is capable of reading the bevel apex position in the lens cross-sectional graphic 701 and an actual distance of the edge position at the lens rear face, is displayed. By using the scale 702, the operator reads a distance dc between the bevel apex position in the lens cross-sectional graphic 701 and the edge position at the lens rear face, and measures a distance Db between the groove center of the rim RM and the nose pad arm KA. By comparing the distance dc and the distance Db, it is possible to confirm whether or not the nose pad arm KA and the lens interfere with each other, and if they interfere, it is possible to obtain the correction processing amount T. In a case where correction processing is required, it is possible to set the correction processing path Q3*n* through the interference avoiding edit screen 600 in FIG. 10. When the correction processing path Q3 is set, the periphery of the lens is subjected to rough processing and bevel finish processing, and the edge corner of the lens rear face is subsequently processed by the chamfering grinding wheel 221*b*.

As described above, in the case where the lens and the nose pad arm KA interfere, the interference position of the nose pad arm KA can be easily designated by adjusting the actual rim RM to the target lens shape graphic FT in a substantially actual size displayed on the display 5. Hence, correction processing necessary for avoiding the interference between the nose pad arm KA and the lens can be easily performed.

Although it has been described above that the operator sets the position of interference between the edge corner of the lens rear face and the nose pad arm KA on the target lens shape graphic by using setting units such as the display 5 and the touch pen TP, other methods are also possible. For example, if design data of the nose pad arm Ka fitted to the eyeglass frame is available, the position data of the nose pad arm KA is received by a receiving unit 55, and accurate interference position Kp is set by the design data of the eyeglass frame. In this case, the operator's trouble of setting can be dispensed with.

In addition, although the case has been described above in which the display 5 has the touch panel function, it is also possible to use a display 5 which is not provided with the touch panel function. In this case, it suffices if necessary data can be inputted by the operation of various switches disposed in the switch section 7.

Furthermore, although a description has been given above by citing as an example a lens on which a bevel has been formed so as to be fitted to an eyeglass frame having a rim, the above-described correction processing can also be applied to a lens subjected to groove cutting processing after the lens periphery is subjected to flat processing or a lens subjected to drilling in the lens refractive surface.

What is claimed is:

1. An eyeglass lens processing apparatus for processing a periphery of a lens, comprising:

a lens edge position detecting unit which obtains edge positions at a front face and a rear face of the lens based on target lens shape data;

an edge corner processing tool which processes an edge corner of the lens rear face;

a correction data input unit which inputs correction data of the edge corner for avoiding interference between an edge of the lens rear face after finish processing and a nose pad arm of an eyeglass frame, the correction data including data on a position of interference between the edge and the nose pad arm, data for setting a processing amount at the interference position, and a processing range of the edge;

a processing data computing unit which determines a processing path of the edge corner of the lens rear face, based on data on the edge position and the correction data, to obtain processing data; and a processing controller which processes the edge corner of the lens rear face by the edge corner processing tool in accordance with the processing data.

2. The eyeglass lens processing apparatus according to claim 1, wherein the correction data input unit includes a display for displaying a target lens shape graphic in a substantially actual size on a screen based on the target lens shape data, and wherein the correction data input unit has a setting unit for designating the interference position in the target lens shape graphic.

3. The eyeglass lens processing apparatus according to claim 1, wherein the correction data input unit includes a display for displaying a target lens shape graphic in a substantially actual size on a screen based on the target lens shape data, and wherein the correction data input unit has a setting unit for designating the edge processing range in the target lens shape graphic.

4. The eyeglass lens processing apparatus according to claim 3, wherein the correction data input unit obtains an intermediate point of the edge processing range as a tentative interference position.

5. The eyeglass lens processing apparatus according to claim 1, wherein the correction data input unit receives design data of the eyeglass frame through a receiving unit to obtain the interference position.

6. The eyeglass lens processing apparatus according to claim 1, wherein the correction data input unit further has a selector for selecting one processing style from among a plurality of processing styles.

7. The eyeglass lens processing apparatus according to claim 1, wherein the processing data computing unit determines the processing path so that the edge processing range has a processing width when the lens is viewed from a rear face side to be maximally large at the interference position, the processing width decreasing as the processing width moves away from the interference position.

8. The eyeglass lens processing apparatus according to claim 1, wherein the processing data computing unit determines the processing path so that the edge processing range has a portion having an identical processing width to the processing width at the interference position.

* * * * *